US005664945A

United States Patent [19]

Maynard et al.

[11] Patent Number: 5,664,945

[45] Date of Patent: Sep. 9, 1997

[54] PRESSURIZED WICK BURNER

[75] Inventors: William B. Maynard, Voorheesville; George Riecke, Ballston Spa, both of N.Y.

[73] Assignee: Mechanical Technology Incorporated, Latham, N.Y.

[21] Appl. No.: 628,471

[22] Filed: Apr. 5, 1996

[51] Int. Cl.[6] ..... F23D 3/02

[52] U.S. Cl. ..... 431/302; 60/524; 431/309

[58] Field of Search ..... 431/302, 303, 431/309; 60/524

[56] References Cited

U.S. PATENT DOCUMENTS 2,075,242 3/1937 Todaro ..... 431/309

*Primary Examiner*—Carroll B. Dority

*Attorney, Agent, or Firm*—Kane, Dalsimer, Sullivan, Kurucz, Levy, Eisele and Richard, LLP

[57] ABSTRACT

A hollow ceramic fiber wick is used for combustion of diesel or other liquid fuels in a small combustor. Fuel and air are provided to the hollow ceramic wick by a positive-displacement fuel pump and a positive-displacement air blower driven by a common microprocessor-controlled driveshaft. A first portion of the air is provided directly to the wick while a second portion of the air is communicated by passageways outwardly concentric from the wick holder to a swirler chamber near the tip of the wick within the combustion chamber.

10 Claims, 4 Drawing Sheets

PRESSURIZED WICK BURNER

BACKGROUND OF THE INVENTION

1. Field of the Invention

This invention pertains to the combustion of diesel or other liquid fuels in a small combustor, and more particularly to the providing of an external heat source for a Stirling engine.

2. Description of the Prior Art

Interest in small burners on the order of 2500 BTU per hour or less introduces a significant problem with the preparation of liquid fuels for combustion. Most liquid fuel burners prepare the fuel for combustion by pressure or air atomizing the fuel to produce small droplets thereby maximizing the surface area of the fuel exposed to the air. The mixing of the fuel and the air in this manner, enhanced by aerodynamic mixing, allows in most cases for efficient and clean combustion.

At extremely low flows required for small burners, pressure atomizing orifices are extremely small, on the order of 0.0005 inches. This is not a practical size when considering manufacture and the potential for the orifice plugging with foreign material. Additionally, pressure atomization at the normally high (50 to 100 psi) pressures adds a significant parasitic power requirement to the system. Alternative techniques to atomize the fuel, such as ultrasonic nozzles and spinning disc atomizers, are available. These, however, have their own unique problems and, with motors, bearings, crystals and power supplies, tend to be complicated, expensive and heavy.

Generally speaking, the simplest, and therefore lightest and least costly, approach to expose a large surface area of a small quantity of fuel to the combustion air is a wick, such as is used in lanterns and space heaters. The wick also requires the minimum fuel pressure of any system, nearly eliminating the parasitic power losses associated with pumping the fuel. However, this type of burner, as currently constructed, has many problems in the server environment of the Stirling engine. Preheated air at about 1000 degrees Fahrenheit is used to feed the burner. Preheating is necessary in a Stirling engine to recover exhaust heat to conserve system energy. This high temperature would result in the consumption of a conventional wick in the presence of a flame. The high temperatures also insure that some portion of the wick will be in a critical temperature range of 200 to 300 degrees Fahrenheit where elements of liquid fuels, particularly diesel, form a lacquer-like substance that plugs the wick, preventing fuel from passing to the wick.

An additional problem is the need for control of the rate of fuel flow to the burner to control the power output of the Stirling engine. Normal wicking action itself is an uncontrolled process. Variation in heat or light output in conventional applications is usually controlled by exposing more or less of the wick surface to the incoming air, allowing a variable amount of the fuel to be consumed. The amount of exposure is usually determined by visual means by the user. This approach, however, is not practical in a Stirling engine application.

Moreover, soot and smoke are major concerns of diesel combustion during start-up, operation, and shut-down.

OBJECTS AND SUMMARY OF THE INVENTION

It is an object of the present invention to provide a burner system which operates in a manner to burn efficiently small quantities of liquid fuels, including diesel.

It is a further object of the present invention to provide a burner for diesel fuels, particularly in a Stirling engine preheater, without the production of significant smoke or soot.

It is a further object of this invention to provide a burner for diesel fuels, particularly in a Stirling engine preheater, which is durable, light-weight and cost-effective.

The apparatus of the present invention uses a fuel-pressurized hollow, ceramic fiber wick as a fuel delivery and vaporization device. Pressurization of the fuel feeding the wick is a technique to augment capillary action and allow a variable quantity of fuel to be delivered to the burner with a fixed exposed surface area of the wick.

Fuel is fed to the ceramic fiber wick by a positive-displacement pump. The quantity of fuel forced into the wick is accurately controlled by the speed of the positive-displacement pump. Overlapping double rows of large holes in the wick sleeve, in combination with the wick stuffer backing up the inside of the wick, distributes the fuel uniformly in the wick. Compression of the wick with the wick stuffer controls the degree of saturation at the critical wick inlet. The positive-displacement fuel pump renders the system insensitive to variations in back pressure.

Wick life is extended by the careful cooling of both sides of the wick to locate the lacquered portion of the wick in the least critical region, where fuel can by-pass the lacquered region and still enter the combustion zone through the clean tip of the wick. To accomplish the internal cooling and by-pass functions, the wick must be hollow. Further protection of the wick from the burner's heat is provided by heat dams in the principal conduction paths.

Air is introduced to the burner through a positive-displacement air blower on a drive shaft in common with the fuel pump. With both the air and fuel pumped by positive-displacement pumps driven by a common drive, a fixed fuel-to-air ratio is introduced into the blower, the rate of which is controlled by the combined blower/pump speed. This reduces the entire burner control to a voltage input to the blower/pump drive motor, eliminating metering and control devices. A microprocessor-based feedback electronic control maintains a pre-selected temperature through a temperature sensor feedback loop that directly controls the voltage to the air/fuel pump.

The above provides for the proper introduction of fuel and air to the combustion zone. To create a clean, smoke-free burner, the mixing of the fuel and air is critical. Unobstructed swirling flow surrounds the wick, but must be introduced to the exposed wick at exactly the proper axial location to induce the high rates of mixing and chemical reaction needed for a clean burner. To develop this swirl, air is introduced through the swirler which has angled slots to initiate the rotation of the air at a high velocity. Further acceleration of the swirl is accomplished in the swirl chamber by the radius reduction from the face of the swirler to the swirl annulus. The external wick cooling air introduced into the swirl chamber must be deflected along the top wall to minimize the detrimental impact on the swirl chamber aerodynamics. The imposition of the ignitor in the swirl chamber is also a detrimental influence on the swirl chamber aerodynamics. After ignition, the ignitor must be retracted.

To further enhance wick life, a "burn back" function must be built into the system control. Burn back is the consumption of residual fuel in the wick and coke formed on the wick during operation. These are consumed by continuing to feed a controlled small quantity of both combustion and cooling air to the wick after the fuel has been shut off and until the quantity of residual fuel in the wick has been completely consumed.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
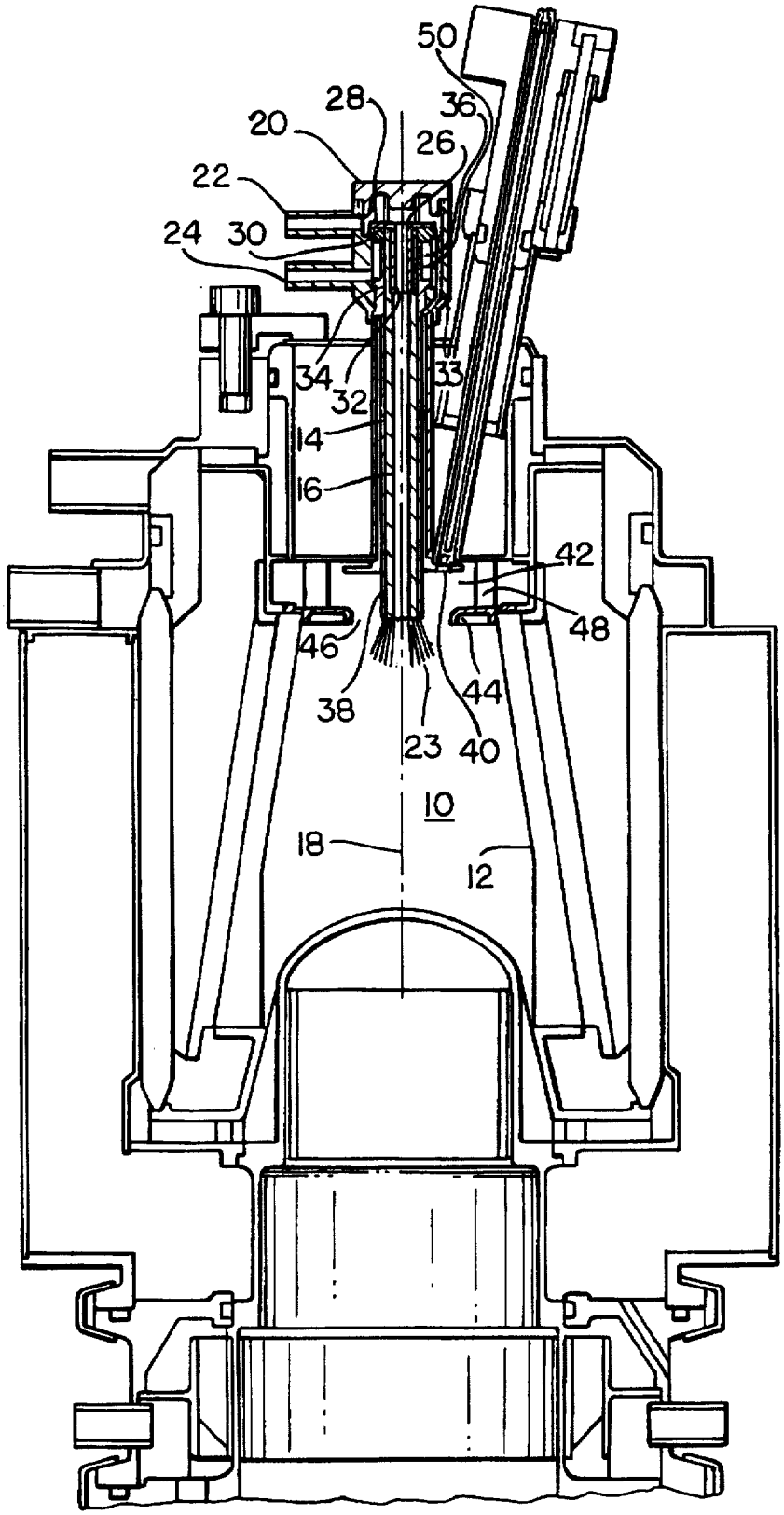
FIG. 1 is a side cross-sectional view of the apparatus of the present invention.

Referring now to the drawings in detail wherein like numerals refer to like elements throughout the several views, one sees that combustion chamber 10 is formed within generally tapered cylindrical closed walls 12. Combustion chamber 10 can be used as a heater for a Stirling engine. Wick tube 14, formed as a cylindrical passageway with hollow ceramic fiber wick 16 therewithin, protrudes into combustion chamber 10. Wick tube 14 provides for control of wick exposure and physical support of the wick 16. The wick 16 is sized to expose a sufficient surface area of the fuel to the air for rapid and clean combustion. Wick tube 14 is illustrated as concentric about the longitudinal axis 18 of combustion chamber 10, but this is not required for the operation of the invention.

Wick 16 is constructed of woven ceramic fibers to survive the high temperature environment in the combustion chamber 10, and still provide the forced capillary action to transport the fuel to the combustion chamber 10. Moreover, the woven ceramic wick 16 is hollow to allow air cooling of the wick interior, to provide for fuel by-pass for oversaturation conditions in the wick 16 and to provide fuel by-pass for wick deterioration with use in order to extend wick life.

The wick manifold assembly 20 of wick tube 14, outward from combustion chamber 10, includes air inlet 22 and fuel inlet 24. Wick 16 is longitudinally held in place by wick stuffer 26 which includes an upper circular flanged portion 28 which abuts and is held in place by inner circular ledge 30 within wick tube 14. Wick stuffer 26 further includes a downwardly extending hollow portion 32. The upper portion of hollow wick 16 is clampingly engaged between the inner wall 34 of wick tube 14 and the outer wall of downwardly extending hollow portion 32 of wick stuffer 26.

Pressurized fuel is fed through fuel inlet 24 to fuel manifold 36 and subsequently directed to the ceramic fibers of wick 16. Fuel manifold 36 is formed in a toroidal shape below the inner cylindrical ledge 30, concentrically inwardly of the cylindrical walls forming wick manifold assembly 20, and concentrically outwardly from the portion of wick 16 extending above wick tube 14. The inner wall of fuel manifold 36 is therefore bounded by a portion of wick 16. Pressurization of the wick augments the capillary action of the wick to increase fuel flow through the wick 16 and allows for a variable feed of fuel to the burner for variable power requirements. The point of entry of the fuel to wick 16 is designed to force the fuel to enter wick 16 in a uniform manner and be retained in the wick fibers. This is accomplished through several holes 50 in alternate rows equally distributed around the wick tube 14 on the outer diameter of the wick 16, backing up the inner diameter of the wick stuffer 26 and designing the gap between the wick stuffer 26 and the wick tube 14 to lightly compress the wick 16 to hold wick 16 in position but not compress the wick 16 excessively so as to prevent the influx of fuel therein.

The restricted portion of wick 16 formed immediately underneath upper circular flanged portion 28 of wick stuffer 26, where the fuel is forced into wick 16, is removed from the hot area of the burner to allow air cooling to kept the temperature below the critical 200–300 degree Fahrenheit lacquering temperature. The hollow center of the wick 16 is left unrestricted from the fuel introduction point of fuel manifold 36 to the flared innermost or burner end 23 of the wick 16 to allow the wick by-pass function that enhances wick life.

Air is fed through air inlet 22 so as to pass over upper circular flanged portion 28. A small portion of the unheated air (prior to preheat) is subsequently directed through downwardly extending hollow portion 32 of wick stuffer 26 and through the hollow center of wick 16 to cool the interior of the wick 16 and to retard lacquering of the wick fibers. The air also aids in the transport of excess fuel to the combustion chamber 10 and provides combustion air to the wick 16 for the burn-back procedure required to clean the wick 16 after each use. The remaining portion of the unheated air is transported around the fuel manifold 36 in the wick manifold assembly 20 by passageways 33 sized for a proper split in flow. This air is used to provide cooling to the exterior of wick 16 to provide cooling to the exterior of wick 16 to retard the formation of a lacquer-like substance on the wick fibers.

The division of internal air (via wick stuffer 26) and external air (via passageways 33) is designed to locate the inevitable lacquering of wick 16 with the diesel fuel close to the innermost or burner end 23 of wick 16, and to contain the lacquering to as small an area in wick 16 as possible. This retains the maximum wicking action and requires the minimum by-pass action to occur adjacent to the combustion-cleaned portion of wick 16. Tests have shown this to be a critical aspect of the wick life.

Passageways 33 are outwardly concentric from wick holder 14 until immediately before the innermost or burner end 38 of wick holder 14 where wick cooling air deflection plate 40 is formed at a right angle to passageways 33 thereby diffusing and deflecting air into toroidal swirler annulus 42 and further preventing disruption of the aerodynamics of the swirling flow into toroidal swirler annulus 42. Toroidal swirler annulus 42 is formed around the innermost or burner end 38 of wick holder 14.

Outwardly concentric from the innermost or burner end 38 of wick tube 14 and further forming a lower boundary to toroidal swirler annulus 42 is swirler cover plate 44. Annular gap 46 is formed between innermost or burner end 38 of wick tube 14 and swirler cover plate 44.

The velocity of the air over wick 16 is controlled by annular gap 46. The size of the annular gap 46 and its axial location relative to the tip 23 of wick 16 is sized to produce rapid vaporization and mixing to promote clean, rapid vaporization.

The angular velocity (swirl) of the air in swirler annulus 42 is designed to promote rapid mixing of the burning gasses in the combustion chamber 10 after the ignition of the flame in swirler annulus 42. The high velocity swirl is developed with a low pressure drop by introducing the swirl through a low pressure drop swirler chamber 48 (formed toroidally at an outer diameter of swirler annulus 42) at a large radius and then accelerating the angular momentum by reducing the radius of swirl with swirler cover plate 44, forcing the air to exit at the smaller diameter orifice in the swirler cover plate 44. Further details of this process are described in commonly-owned U.S. Pat. No. 5,090,894, which is incorporated herein by reference.

The wick 16 and wick tube 14 are isolated and insulated from the heat source in the burner by reducing the metallic heat paths to wick 16 through minimizing wall thickness and continuity (through holes 50 drilled in the non-sealing wall portions of wick tube 14) and reduced number of conducting walls.

Figure 2A:
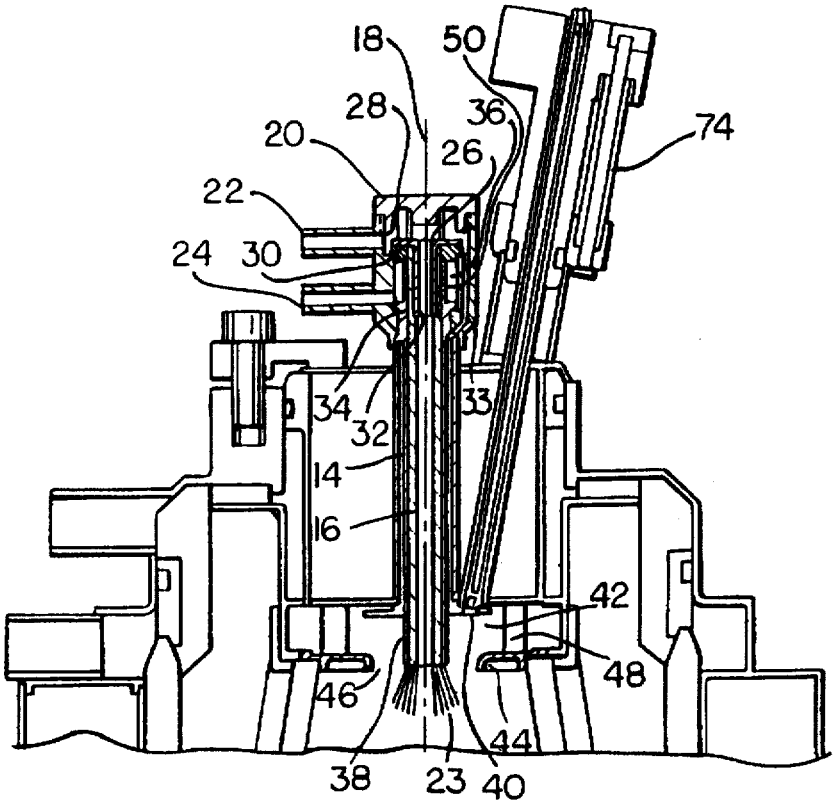
FIG. 2*a* is a cross-sectional side view showing the ignitor mounted to the upper end of the combustor.
Figure 2B:
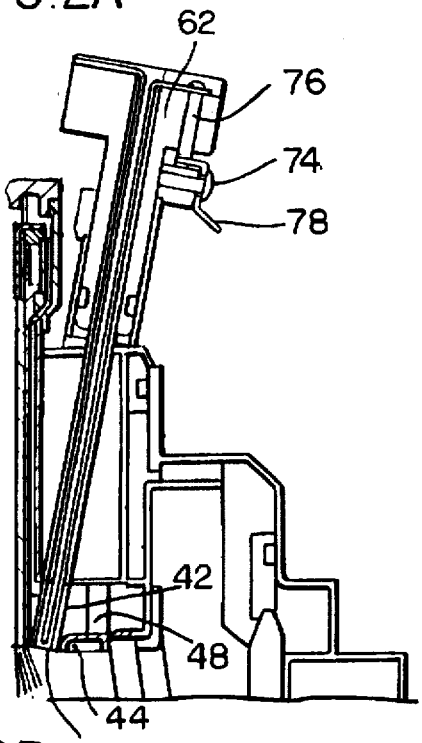
FIG. 2*b* is a cross-sectional side view showing the ignitor fully depressed and the switch in the closed position.

As shown in FIGS. 1, 2A and 2B, ignitor 60 is mounted obliquely with wick tube 14 and with longitudinal axis 18 of combustion chamber 10. Ignitor 60 includes a cylindrical plunger 62 with an ignitor element 64 formed along longitudinal axis 66 thereof. Plunger assembly 62 is slidably mounted within cylindrical sheath 68, thereby forming a manual, spring-loaded configuration with automatic retraction after ignition. As seen in FIG. 2A, the tip 70 of ignitor element 64 is withdrawn within passageway 72 during normal operation. However, when plunger 62 is depressed, as shown in FIG. 2B, tip 70 extends proximately adjacent to the tip of wick 16.

FIG. 2B illustrates the plunger 62 in a depressed position with switch 74 turned at a ninety degree angle so as to expose electrical contacts 76, 78. Electrical contacts 76, 78 are located at the end of the insertion stroke so that power is not supplied to the ignitor 60 until the ignitor element 64 is in the proper position. This conserves start-up power and prevents accidental shorting of the ignitor 60 to nearby metal swirler surfaces such as swirler cover plate 44.

Figure 3:
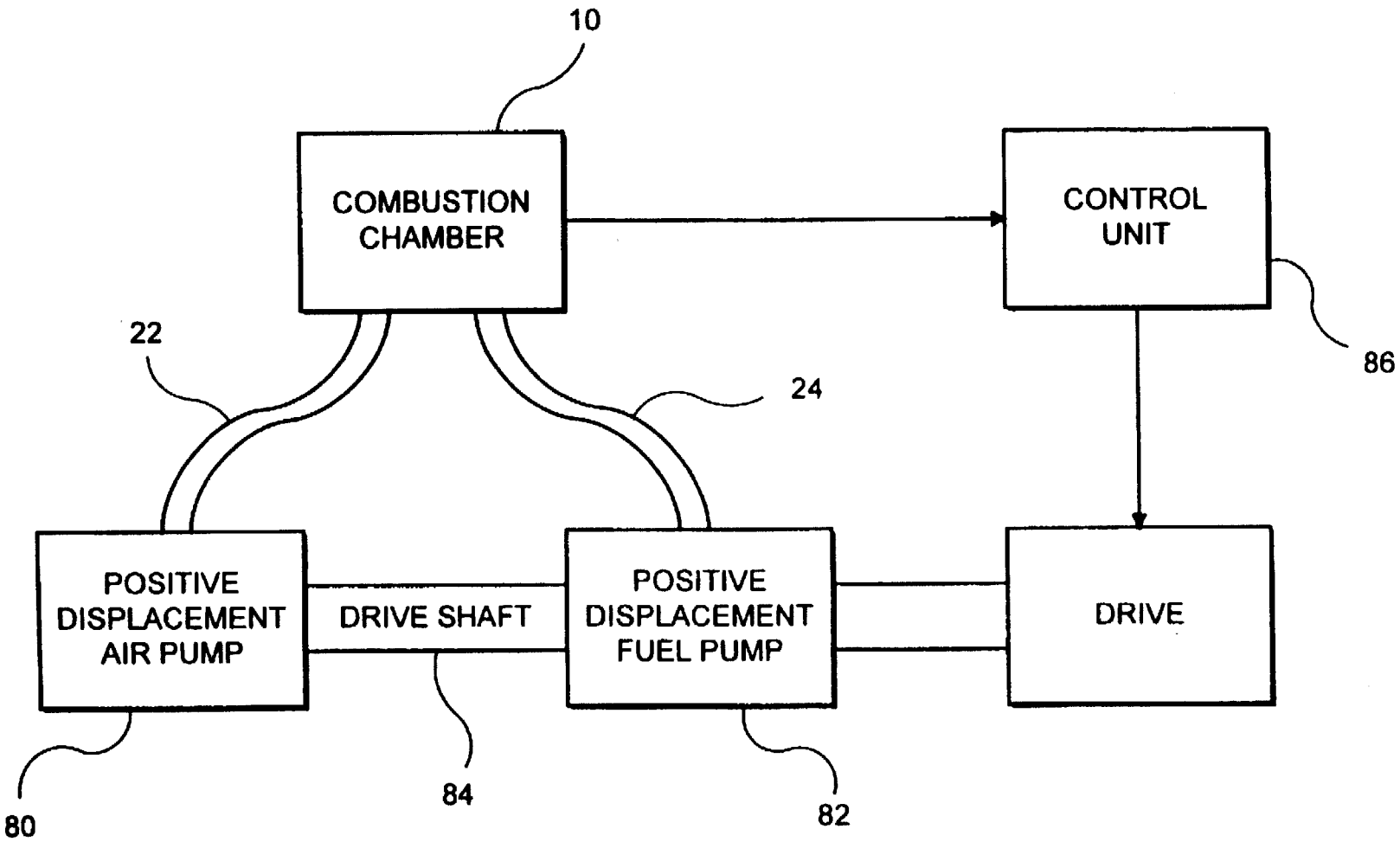
FIG. 3 is a schematic view of the relationship of the positive-displacement air pump, the positive-displacement fuel pump, the common driveshaft and the combustion chamber of the preheater of the present invention.

As shown in FIG. 3, air and fuel are forced into the combustion chamber 10 with both a positive-displacement air blower 80 (via air inlet 22) and a positive-displacement fuel pump 82 (via fuel inlet 24) on a common driveshaft 84 powered by drive 88 to provide an optimum air-fuel mixture throughout the operating range. The fuel-air mixture ratio is maintained by the positive-displacement feature of both the air blower 80 and the fuel pump 82 and the speed ratio between the air blower 80 and the fuel pump 82. The positive-displacement feature eliminates the influence of variable back pressure resulting from system heating, variations in manufacture and deterioration of the system through use. The quantity of air and fuel is controlled through a microprocessor based feedback control 86 sensing a critical temperature, such as that of the Stirling engine heater head, and controlling the rotational output of drive 88 to common driveshaft 84.

Control simplification is provided by the combined features of a common driveshaft 84 and positive displacement in both the air blower 80 and fuel pump 82. A fixed quantity of air and fuel, at the appropriate mixture, are introduced into the burner as a function of shaft speed alone. Separate measurement and control of both fuel and air are eliminated.

Figure 4:
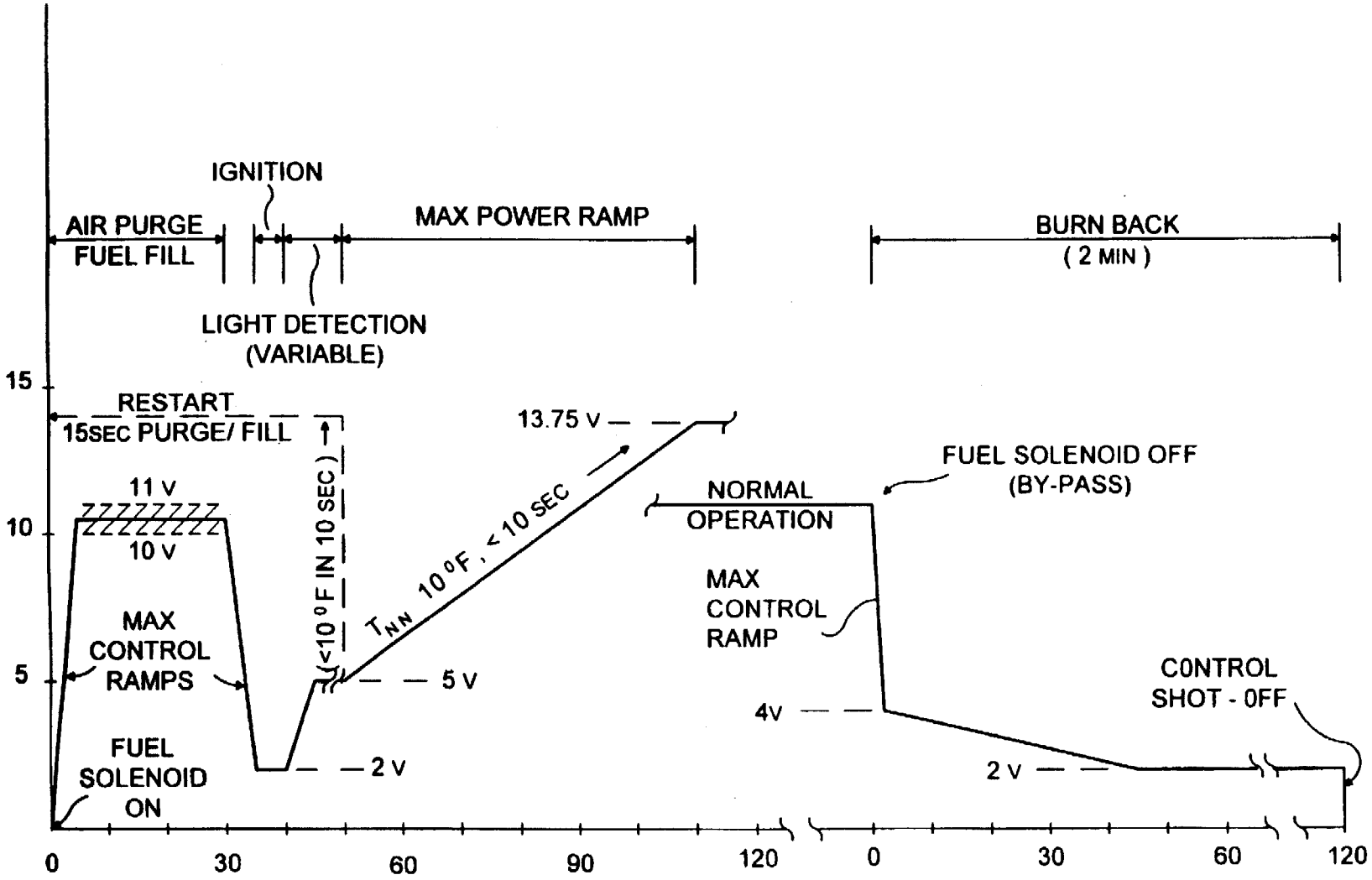
FIG. 4 is a schematic of a typical start-up and shut-down sequence for the apparatus of the present invention.

FIG. 4 illustrates the start-up and shut-down sequences of the apparatus of the present invention. Start-up incorporates fuel line filling, air purge of the burner, low flow ignition, ignition detection, restart cycling (if needed), and a max power ramp to thermally stabilize the system. Shut-down includes fuel by-pass to shut off the fuel to the burner, airflow ramped at a rate to consume the residual fuel in the wick 16 and a "burn back" period to consume residual carbon and lacquer on the wick 16.

The apparatus of the present invention can be readily converted to use with alcohols, kerosene and gasoline with minor modifications for viscosity, heat rate and surface tension.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A heater apparatus including;

a combustion chamber;

means forming a passageway with a hollow annular ceramic wick therein, said passageway including a first and a second end, said first end leading into said combustion chamber;

a fuel inlet and an air inlet in communication with said second end of said passageway, and passage means whereby at least a portion of the fuel is fed through said hollow ceramic wick to said combustion chamber and a portion of said air is fed about an exterior surface of said wick to said combustion chamber; a wick stuffing means for holding said hollow ceramic wick in said passageway including an aperture through a central portion thereof providing communication between said air input and hollow portion of said hollow ceramic wick.

2. The heater apparatus of claim 1 wherein a hollow toroidal chamber is formed concentrically outward from a portion of said hollow ceramic wick, said hollow toroidal chamber being in communication with said fuel input thereby forming a fuel manifold chamber.

3. The heater apparatus of claim 1 wherein said aperture is concentrically bounded by cylindrical walls which impinge against an interior of said hollow portion of said hollow ceramic wick.

4. The heater apparatus of claim 3 wherein said wick stuffing means further includes an upper disk portion which forms a ledge abutting an end of said hollow ceramic wick, and wherein said aperture passes through a center of said upper disk portion.

5. The heater apparatus of claim 4 including means whereby air from said air input passes over said disk portion through said air passageways to said combustion chamber.

6. The heater apparatus of claim 5 further including swirler means for diverting and swirling an air stream from said air passageways at a right angle before exiting therefrom.

7. The heater apparatus of claim 6 wherein said swirler means includes a toroidal swirler chamber formed outwardly concentrically from said first end of said passageway and having a restricted opening providing communication between said toroidal swirler chamber and said combustion chamber.

8. The heater apparatus of claim 1 wherein said fuel inlet is provided fuel by a positive-displacement fuel pump and said air inlet is provided air by a positive-displacement air blower, wherein said fuel pump and said air blower are driven by a common driveshaft.

9. The heater apparatus of claim 8 further including a control means for determining a desired rotational speed of said driveshaft, said control means being responsive to a temperature of said combustion chamber.

10. The heater apparatus of claim 1 wherein fuel inlet pressure and quantity augments wicking of fuel and provides a significant turn down ratio of the heater apparatus.

* * * * *